US005686010A

United States Patent [19]

Lee

[11] Patent Number: 5,686,010

[45] Date of Patent: Nov. 11, 1997

[54] CONNECTING DEVICE FOR FORM PANELS

[76] Inventor: Wen-Yuan Lee, 7F-3, No. 8, Lane 390, Sec. 1, Chien-Kang Rd., Tainan City, Taiwan

[21] Appl. No.: 390,582

[22] Filed: Feb. 17, 1995

[51] Int. Cl.[6] ..... E04G 11/06

[52] U.S. Cl. ..... 249/193; 249/161; 249/196

[58] Field of Search ..... 249/193, 161, 249/196

[56] References Cited

U.S. PATENT DOCUMENTS

| | | | |
|---|---|---|---|
| 1,270,793 | 7/1918 | Davidson | 249/193 |
| 1,906,291 | 5/1933 | Wales | 249/193 |
| 3,931,951 | 1/1976 | Fougea | 249/158 |
| 5,552,103 | 9/1996 | Lee | 249/193 |

*Primary Examiner*—Thomas R. Weber

*Attorney, Agent, or Firm*—Birch, Stewart, Kolasch & Birch, LLP

[57] ABSTRACT

A connecting device is provided for interconnecting two juxtaposed upright form panels used in forming a concrete wall. The form panels have adjacent mating edges between which an edge connecting plate is interposed tightly and removably. The connecting device includes first and second mounting plates secured respectively to the form panels adjacent to the mating edges of the form panels. Each of a pair of guide rods has an end portion extending through the first mounting plate and secured to the second mounting plate so as to permit relative lateral movement between the form panels. A driving screw has a threaded shank portion which extends through the first mounting plate and which extends threadably through the second mounting plate. A positioning screw has a threaded shank portion extending threadably through the second mounting plate and abutting against the first mounting plate. When the edge connecting plate is removed, and the positioning screw is loosened to move the positioning screw away from the first mounting plate, rotation of the driving screw in a predetermined direction causes movement of the first mounting plate toward the second mounting plate so as to facilitate stripping of the form panels from the concrete wall.

20 Claims, 4 Drawing Sheets

CONNECTING DEVICE FOR FORM PANELS

BACKGROUND OF THE INVENTION

1. Field of the Invention

This invention relates to a connecting device, more particularly to a connecting device which interconnects two juxtaposed upright form panels used in forming a concrete wall and which facilitates stripping of the form panels from the concrete wall.

2. Description of the Related Art

Presently, inner and outer steel form panels are usually used to define therebetween a pouring space into which concrete is poured and cast to form the surrounding walls of a building. After the concrete is cast, the outer steel form panels are easily removed with the use of a lifting equipment. However, the inner steel form panels cannot be easily removed with the use of the lifting equipment since the space formed among the inner steel form panels is not large enough accommodate the lifting equipment. Furthermore, since the inner steel form panels are in tight contact with adjacent steel form panels which are used to form an adjacent concrete surrounding wall of the building, stripping of the form panels from the concrete surrounding wall cannot be conveniently performed.

SUMMARY OF THE INVENTION

The main objective of the present invention is to provide a connecting device which interconnects two juxtaposed upright form panels used in forming a concrete wall and which facilitates stripping of the form panels from the concrete wall.

According to the present invention, a connecting device is disclosed for interconnecting two juxtaposed upright form panels used in forming a concrete wall. The form panels have adjacent mating edges between which an edge connecting plate is interposed tightly and removably. The connecting device includes first and second mounting plates to be secured respectively to the form panels adjacent to the mating edges of the form panels. The first mounting plate is formed with a through-hole. The second mounting plate is formed with a first screw hole which is aligned with the through-hole in the first mounting plate and a second screw hole on one side of the first screw hole. Each of a pair of guide rods has an end portion extending through the first mounting plate and secured to the second mounting plate so as to permit relative lateral movement between the form panels. A driving screw has a threaded shank portion which extends through the through-hole in the first mounting plate and which engages threadably the first screw hole in the second mounting plate, and a head portion which is sized to prevent extension thereof through the through-hole in the first mounting plate. A positioning screw has a threaded shank portion extending threadably through the second screw hole in the second mounting plate, and abutting against the first mounting plate. When the edge connecting plate is removed, and the positioning screw is loosened to move the positioning screw away from the first mounting plate, rotation of the driving screw in a predetermined direction causes movement of the first mounting plate toward the second mounting plate so as to facilitate stripping of the form panels from the concrete wall.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in art from this detailed description.

BRIEF DESCRIPTION OF THE DRAWINGS

Other features and advantages of the present invention will become apparent in the following detailed description of the preferred embodiment, with reference to the accompanying drawings which are given by way of illustration only, and thus are not limitative of the present invention, and of which.

DETAILED DESCRIPTION OF THE PREFERRED EMBODIMENT

Figure 1:
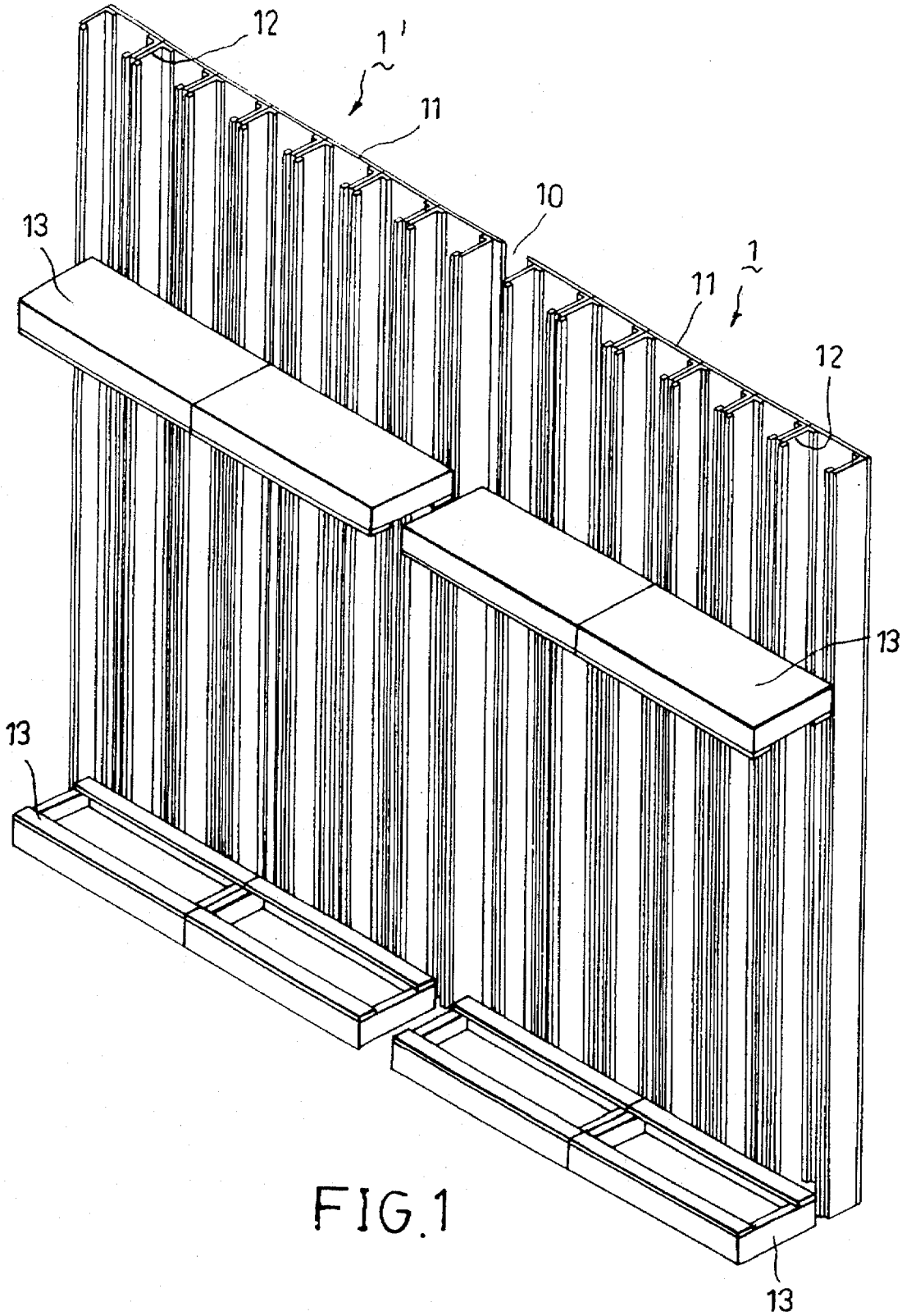
FIG. 1 is a perspective view illustrating two juxtaposed form panels which are used in forming a concrete wall and which are to be provided with a connecting device according to the present invention.
Figure 2:
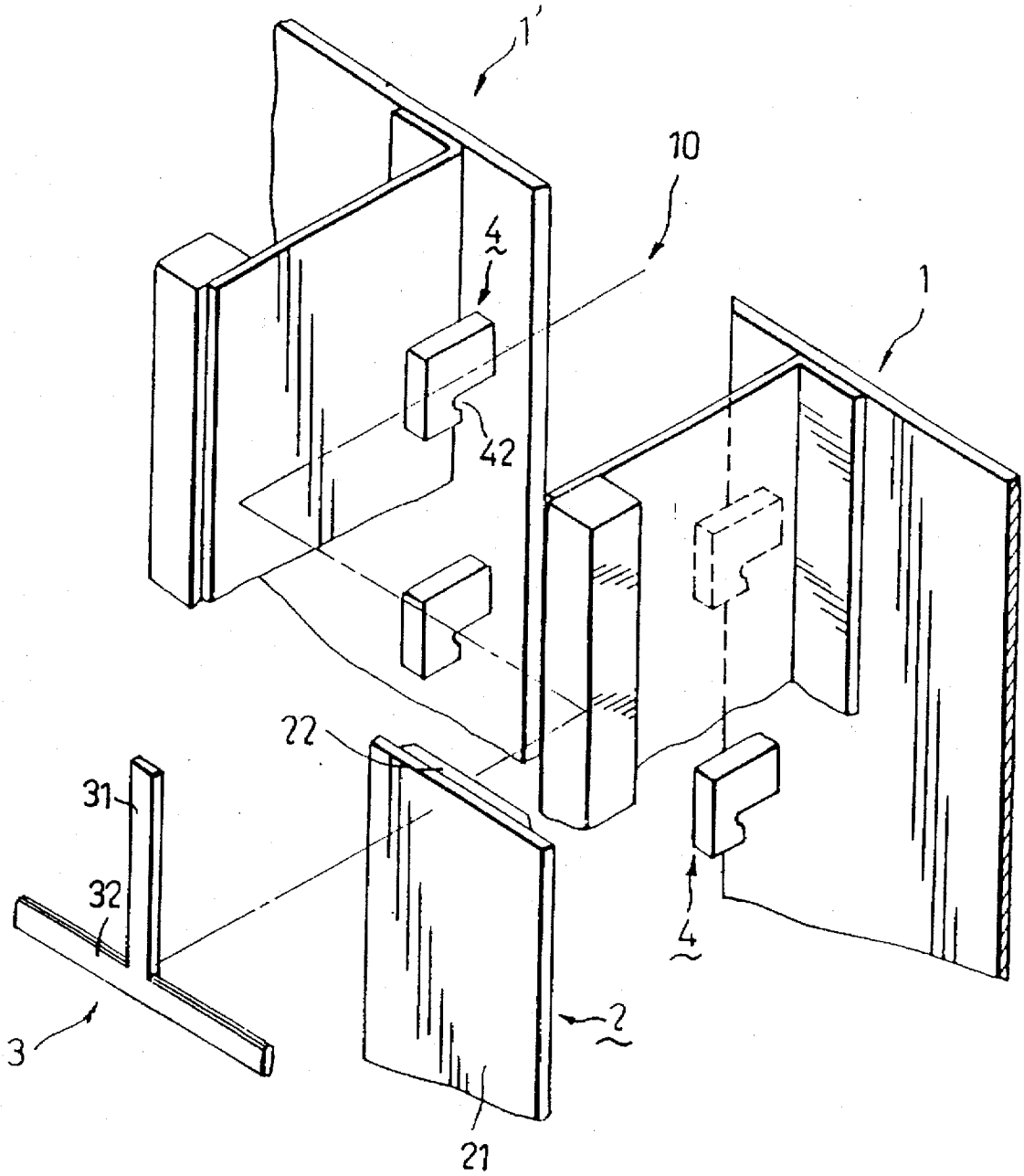
FIG. 2 is an enlarged view showing portions of the form panels of FIG. 1, the form panels having adjacent mating edges between which an edge connecting plate is interposed tightly and removably.
Figure 3:
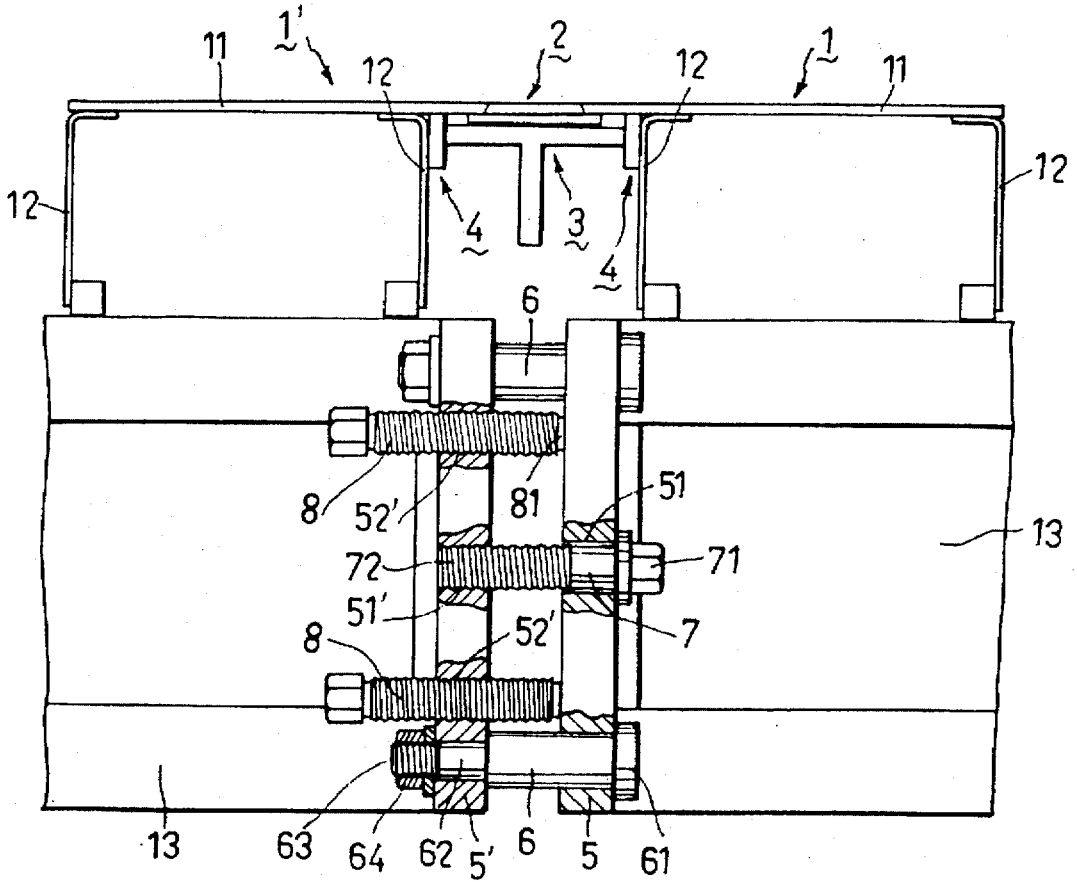
FIG. 3 is a plan view illustrating the form panels which are incorporated with a connecting device according to the present invention.

FIG. 1 shows two juxtaposed upright form panels 1,1' which are to be incorporated with a connecting device according to the present invention and which cooperatively define a receiving space 10 between adjacent mating edges thereof. The form panels 1,1' are used in forming a concrete wall (not shown) and are developed by the applicant. The structure of the form panels 1,1' are generally identical. Each of the form panels 1,1' consists of a plurality of panel members 11 which are arranged side by side. Each panel member 11 has a plurality of upright support ribs 12 connected perpendicularly thereto on a back surface of the panel member 11. The form panels 1,1' have aligned horizontal reinforcing beam members 13 connected transversely to the support ribs 12. Referring to FIGS. 2 and 3, each form panel 1,1' is formed with a plurality of vertically aligned positioning seat members 4 adjacent to the mating edge thereof. Each positioning seat member 4 on one of the form panels 1,1' is aligned with a corresponding seat member 4 on the other one of the form panels 1,1'. Each seat member 4 has a lower portion formed with a retaining opening 42 which opens toward the respective form panel 1,1'. When the form panels 1,1' are used in forming the concrete wall, an edge connecting plate 2 is interposed between the mating edges of the form panels 1,1'. The edge connecting plate 2 has an upright plate portion 21 and an insert portion 22 which extends from the plate portion 21 and which is received fittingly in the receiving space 10. The width of the plate portion 21 is slightly greater than that of the insert portion 22 so as to prevent movement of the connecting plate 2 toward the form panels 1,1' in a direction perpendicular to the latter. A generally inverted T-shaped retaining plate 3 has an elongated retaining portion 32 and an elongated operating portion 31 extending from the retaining portion 32. The retaining plate 3 is initially provided adjacent to the lower portion of an aligned pair of seat members 4 on the form panels 1,1'. Then, the operating portion 31 is rotated 90 degrees relative to the form panels 1,1' to cause the retaining portion 32 to engage the openings 42 of the aligned pair of seat members 4 on the form panels 1,1' at two distal ends of the retaining portion 32. It should be noted that the thickness of the retaining portion 32 is equal to the width of the opening 42, and that the sum of the width of the retaining portion 32 and the thickness of the plate portion 21 of the connecting plate 2 is equal to the distance between one end of the opening 42 and the form panel 1,1' such that movement of the retaining plate 3 relative to the seat member 4 is prohibited, thereby preventing movement of the connecting plate 2 away from the form panels 1,1' in the direction perpendicular to the latter. It should also be noted that each aligned pair of seat members 4 on the form panels 1,1' engages a corresponding retaining plate 3. However, only one retaining plate 3 is illustrated in the drawings.

Figure 4:
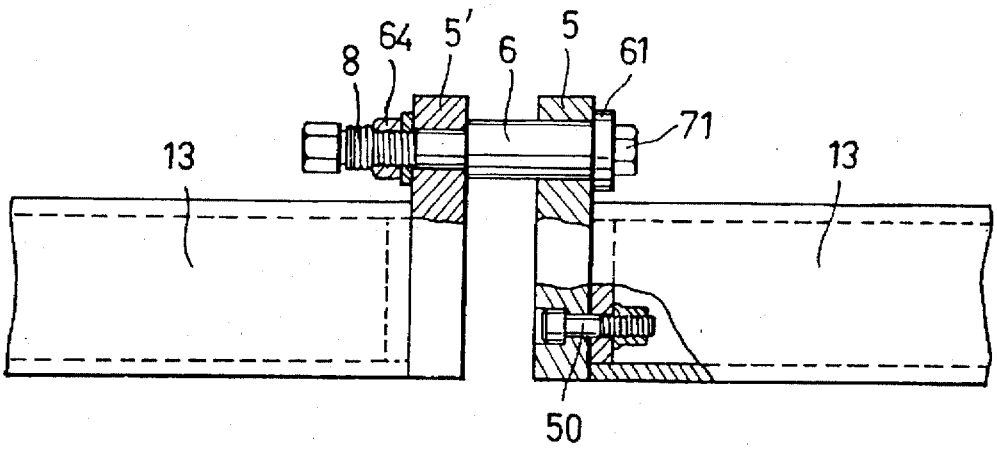
FIG. 4 is a side view illustrating the relationship between the form panels and the connecting device according to the present invention.

Referring now to FIGS. 3 and 4, the connecting device according to the present invention is provided on the beam members 13 of the form panels 1,1' and includes first and second mounting plates 5,5', a pair of guide rods 6, a driving screw 7 and two positioning screws 8.

The first and second mounting plates 5,5' are secured respectively to the beam members 13 of the form panels 1,1' adjacent to the mating edges of the form panels 1,1' by means of a locking bolt 50 which extends through the respective mounting plate 5,5'. The first mounting plate 5 is formed with a through-hole 51. The second mounting plate 5' is formed with a first screw hole 51' which is aligned with the through-hole 51 in the first mounting plate 5 and two second screw holes 52' on two sides of the first screw hole 51'.

Each of the guide rods 6 has a head portion 61 abutting against the first mounting plate 5, a larger rod portion extending through the first mounting plate 5, a smaller rod portion 62 extending through the second mounting plate 5', and a threaded end portion 63 which extends through the second mounting plate 5' and which is provided with a nut 64 so as to secure the guide rod 6 to the second mounting plate 5' in order to permit relative lateral movement between the first and second mounting plates 5,5' and thus, the form panels 1,1'.

The driving screw 7 has a threaded shank portion 72 which extends through the through-hole 51 in the first mounting plate 5 and which engages threadably the first screw hole 51' in the second mounting plate 5', and a head portion 71 which is sized to prevent extension thereof through the through-hole 51 in the first mounting plate 5.

Each of the positioning screws 8 has a threaded shank portion 81 which extends threadably through a respective one of the second screw holes 52' in the second mounting plate 5' and abuts against the first mounting plate 5.

Figure 5:
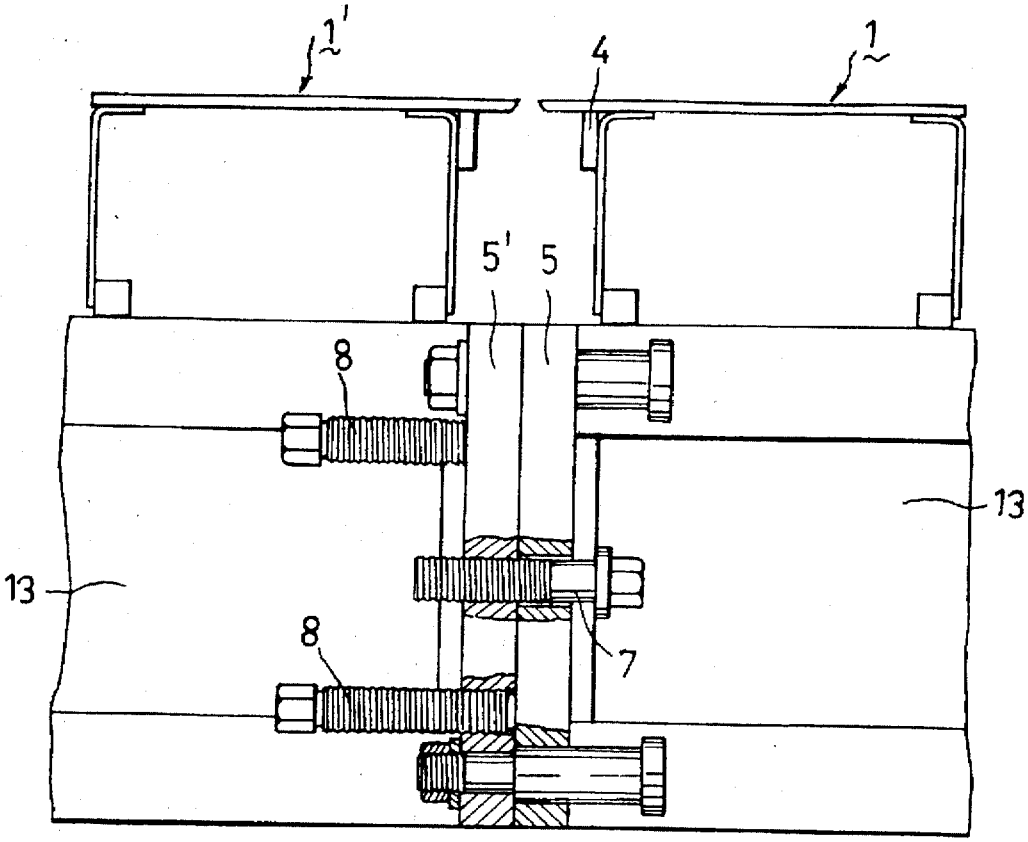
FIG. 5 is a top view similar to that of FIG. 3, the mounting plates of the connecting device according to the present invention being moved toward each other.
Figure 6:
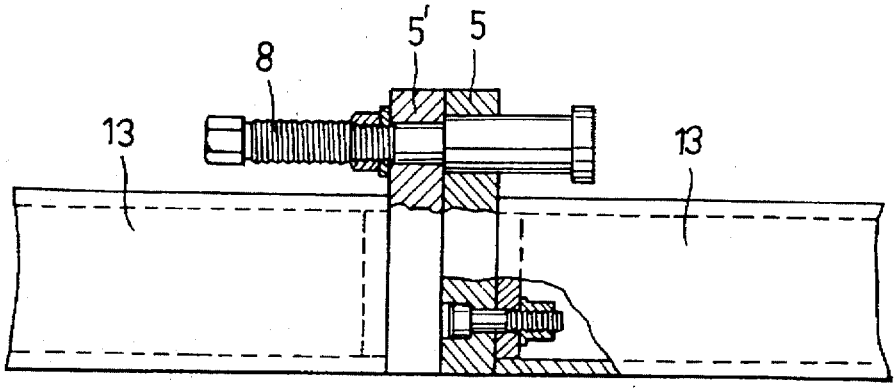
FIG. 6 is a side view illustrating the relationship between the form panels and the connecting device according to the present invention when the mounting plates are moved toward each other.

Referring now to FIGS. 3, 5 and 6, when stripping the form panels 1,1' from a cast concrete wall, the retaining plates 3 are initially disengaged from the seat members 4 so as to permit removal of the connecting plate 2. Then, the positioning screws 8 are loosened to move the positioning screws 8 away from the first mounting plate 5. At this time, rotation of the driving screw 7 in a predetermined direction causes movement of the first mounting plate 5 toward the second mounting plate 5'. Since the mounting plates 5,5' are secured to the beam members 13 of the form panels 1,1' the form panel 1 is thus moved toward the form panel 1' so that the form panels 1,1' are no longer in tight contact with adjacent form panels (not shown), thereby facilitating stripping of the form panels 1,1' from the concrete wall. It should be noted that the number of positioning screws 8 and driving screw 7 employed may be varied as desired. Since the form panels 1,1' are made of steel, the attachment force of concrete on the form panels 1,1' is relatively low, thereby minimizing the force required to rotate the driving screw 7.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A connecting device for interconnecting two juxtaposed upright form panels used in forming a concrete wall, said form panels having adjacent mating edges between which an edge connecting plate is interposed tightly and removably, said connecting device comprising:

first and second mounting plates secured respectively to said form panels adjacent to said mating edges of said form panels, said first mounting plate being formed with a through-hole, said second mounting plate being formed with a first screw hole which is aligned with said through-hole in said first mounting plate and a second screw hole on one side of said first screw hole;

a pair of guide rods, each of which having an end portion extending through said first mounting plate and secured to said second mounting plate so as to permit relative lateral movement between said form panels;

a driving screw having a threaded shank portion which extends through said through-hole in said first mounting plate and which engages threadably said first screw hole in said second mounting plate, and a head portion which is sized to prevent extension thereof through said through-hole in said first mounting plate; and a positioning screw having a threaded shank portion extending threadably through said second screw hole in said second mounting plate, and abutting against said first mounting plate;

whereby, when said edge connecting plate is removed and said positioning screw is loosened to move said positioning screw away from said first mounting plate, rotation of said driving screw in a predetermined direction causes movement of said first mounting plate toward said second mounting plate so as to facilitate stripping of said form panels from said concrete wall.

2. The connecting device as recited in claim 1, wherein the two form panels are generally linearly aligned when the connecting plate is interposed therebetween.

3. The connecting device as recited in claim 1, wherein the driving screw is between the pair of guide rods.

4. The connecting device as recited in claim 3, wherein said second mounting plate has an other second screw hole, such that the second mounting plate has two second screw holes and wherein said connecting device further comprising a second positioning screw having a threaded shank portion extending threadably through said other second screw hole in said second mounting plate and abutting against said first mounting plate.

5. The connecting device as recited in claim 4, wherein said driving screw is between the two positioning screws.

6. The connecting device as recited in claim 5, wherein said two positioning screws are between the guide rods.

7. The connecting device as recited in claim 6, wherein said edge connecting plate is generally aligned with the pair of guide rods, the driving screws and the positioning screws when the edge connecting plate is interposed between the form panels.

8. The connecting device as recited in claim 1, wherein said second mounting plate has an other second screw hole, such that the second mounting plate has two second screw holes and wherein said connecting device further comprising a second positioning screw having a threaded shank portion extending threadably through said other second screw hole in said second mounting plate and abutting against said first mounting plate.

9. The connecting device as recited in claim 1, wherein said edge connecting plate has a plate portion and an insert portion extending from the plate portion, a width of the plate portion being greater than a width of the insert portion.

10. The connecting device as recited in claim 1, further comprising at least one seat member on each of the form panels, the seat members being adjacent to the mating edges of the form panels and a seat member on one form panel being aligned with a seat member on an adjacent form panel to form a pair of seat members.

11. The connecting device as recited in claim 10, further comprising a retaining plate, the retaining plate having an elongated retaining portion which is engageable with a pair of seat members to hold the connecting plate in position relative to the form panels.

12. The connecting device as recited in claim 11, wherein each seat member has an opening for receiving the retaining portion of the retaining plate when the retaining plate is rotated away from the form panels.

13. The connecting device as recited in claim 1, wherein each form panel has a plurality of support ribs and at least one reinforcing beam member, the support ribs being generally perpendicular to the reinforcing beam member and being connected thereto, the first and second mounting plates being secured to a beam member on the form panel to which the mounting plates are secured.

14. The connecting device as recited in claim 1, wherein the form panels are generally vertically oriented when forming a concrete wall, one connecting plate being interposable between two of the form panels.

15. The connecting device as recited in claim 1, wherein the form panels and the interposed connecting plate are generally aligned in a vertical plane.

16. A connecting device for interconnecting two juxtaposed upright panels, said panels having adjacent mating edges, said connecting device comprising:

first and second mounting plates secured respectively to said panels adjacent to said mating edges of said panels, said first mounting plate being formed with a through-hole, said second mounting plate being formed with a first screw hole which is aligned with said through-hole in said first mounting plate and a second screw hole on one side of said first screw hole;

a guide rod having an end portion extending through said first mounting plate and secured to said second mounting plate so as to permit relative lateral movement between said panels; and a driving screw having a threaded shank portion which extends through said through-hole in said first mounting plate and which engages threadably said first screw hole in said second mounting plate, and a head portion which is sized to prevent extension thereof through said through-hole in said first mounting plate;

whereby rotation of said driving screw in a predetermined direction causes movement of said first mounting plate toward said second mounting plate.

17. The connecting device as recited in claim 16, further comprising a positioning screw having a threaded shank portion extending threadably through said second screw hole in said second mounting plate, and abutting against said first mounting plate.

18. The connecting device as recited in claim 16, wherein said second mounting plate has an other second screw hole, such that the second mounting plate has two second screw holes and wherein said connecting device further comprising a second positioning screw having a threaded shank portion extending threadably through said other second screw hole in said second mounting plate and abutting against said first mounting plate.

19. The connecting device as recited in claim 18, wherein said driving screw is between the two positioning screws.

20. The connecting device as recited in claim 16, further comprising a second guide rod having an end portion extending through said first mounting plate and secured to said second mounting plate, wherein said driving screw is located between said guide rods.

* * * * *